US009694553B2

(12) United States Patent
Wnek

(10) Patent No.: US 9,694,553 B2
(45) Date of Patent: Jul. 4, 2017

(54) TOOL FOR FORMING A THREE DIMENSIONAL CONTAINER OR CONSTRUCT

(71) Applicant: Graphic Packaging International, Inc., Atlanta, GA (US)

(72) Inventor: Patrick H. Wnek, Sherwood, WI (US)

(73) Assignee: Graphic Packaging International, Inc., Atlanta, GA (US)

( * ) Notice: Subject to any disclaimer, the term of this patent is extended or adjusted under 35 U.S.C. 154(b) by 1029 days.

(21) Appl. No.: 13/912,651

(22) Filed: Jun. 7, 2013

(65) Prior Publication Data

US 2013/0267398 A1 Oct. 10, 2013

Related U.S. Application Data

(62) Division of application No. 12/817,377, filed on Jun. 17, 2010, now Pat. No. 8,480,551.

(60) Provisional application No. 61/187,849, filed on Jun. 17, 2009.

(51) Int. Cl.
*B31B 43/00* (2006.01)

(52) U.S. Cl.
CPC ..... *B31B 43/00* (2013.01); *B31B 2201/0252* (2013.01); *B31B 2201/223* (2013.01)

(58) Field of Classification Search
None
See application file for complete search history.

(56) References Cited

U.S. PATENT DOCUMENTS

| | | | |
|---|---|---|---|
| 228,554 | A | 6/1880 | Perkins et al. |
| 584,633 | A | 6/1897 | Gottlieb |
| 1,022,882 | A | 4/1912 | Schwenn |
| 1,733,445 | A | 10/1929 | Burns |
| 1,838,061 | A | 12/1931 | Schwaerzer |
| 2,522,397 | A | 9/1950 | Palmer |
| 2,634,880 | A | 4/1953 | Gravatt |
| 2,731,860 | A | 1/1956 | Schaming |
| 3,033,434 | A | 5/1962 | Carson |
| 3,099,377 | A | 7/1963 | Metzler et al. |
| 3,195,770 | A | 7/1965 | Robertson |
| 3,220,631 | A | 11/1965 | Reifers |
| 3,229,886 | A | 1/1966 | Grogel |

(Continued)

FOREIGN PATENT DOCUMENTS

| | | |
|---|---|---|
| DE | 509 065 | 4/1969 |
| DE | 80 11 020 | 9/1980 |

(Continued)

OTHER PUBLICATIONS

International Search Report and Written Opinion for PCT/US2010/038953 dated Jan. 28, 2011.

(Continued)

*Primary Examiner* — Hemant M Desai
*Assistant Examiner* — Mobeen Ahmed
(74) *Attorney, Agent, or Firm* — Womble Carlyle Sandridge & Rice, LLP

(57) ABSTRACT

A tool having a blank positioning system and method for forming a container. The tool has a first tool assembly and a second tool assembly that cooperate to shape the container from a blank. The blank positioning system positions the blank between the first tool assembly and the second tool assembly prior to forming the blank into the container.

17 Claims, 8 Drawing Sheets

(56) References Cited

U.S. PATENT DOCUMENTS

| | | | | |
|---|---|---|---|---|
| 3,286,876 | A | 11/1966 | Ring | |
| 3,530,917 | A | 9/1970 | Donavan | |
| 3,669,305 | A | 6/1972 | Kinney et al. | |
| 3,680,733 | A | 8/1972 | Winslow | |
| 3,684,633 | A | 8/1972 | Haase | |
| 3,777,628 | A | 12/1973 | Nickum | |
| 3,823,460 | A * | 7/1974 | Bergmann | B21D 28/22 29/738 |
| 3,850,340 | A | 11/1974 | Siemonsen et al. | |
| 3,968,921 | A | 7/1976 | Jewell | |
| 4,051,707 | A | 10/1977 | Valek et al. | |
| 4,073,391 | A | 2/1978 | O'Brien et al. | |
| 4,090,903 | A | 5/1978 | Matsui | |
| 4,096,947 | A | 6/1978 | Morse | |
| 4,139,115 | A | 2/1979 | Robinson | |
| 4,183,435 | A | 1/1980 | Thompson et al. | |
| 4,202,464 | A | 5/1980 | Mohs et al. | |
| 4,358,263 | A | 11/1982 | Shiraishi et al. | |
| 4,435,143 | A | 3/1984 | Dempsey | |
| 4,571,320 | A | 2/1986 | Walker | |
| 4,606,496 | A | 8/1986 | Marx et al. | |
| 4,609,140 | A | 9/1986 | Van Handel et al. | |
| 4,645,155 | A | 2/1987 | Eldon et al. | |
| 4,648,528 | A | 3/1987 | LaBarge et al. | |
| 4,704,510 | A | 11/1987 | Matsui | |
| 4,721,499 | A | 1/1988 | Marx et al. | |
| 4,721,500 | A | 1/1988 | Van Handel et al. | |
| 4,755,128 | A | 7/1988 | Alexander et al. | |
| 4,775,771 | A | 10/1988 | Pawlowski et al. | |
| 4,781,566 | A * | 11/1988 | Rossi | B29C 51/26 425/400 |
| 4,832,676 | A * | 5/1989 | Johns | B31B 43/00 264/320 |
| 4,865,921 | A | 9/1989 | Hollenberg et al. | |
| 4,890,439 | A | 1/1990 | Smart | |
| 4,935,089 | A | 6/1990 | Schirmer | |
| 4,936,935 | A | 6/1990 | Beckett | |
| 4,963,424 | A | 10/1990 | Beckett | |
| 4,967,908 | A | 11/1990 | Kessler | |
| 5,039,364 | A | 8/1991 | Beckett et al. | |
| 5,117,078 | A | 5/1992 | Beckett | |
| 5,129,874 | A * | 7/1992 | Hayes, III | B31B 1/44 264/320 |
| 5,190,209 | A | 3/1993 | Gordon et al. | |
| 5,213,902 | A | 5/1993 | Beckett | |
| 5,221,419 | A | 6/1993 | Beckett | |
| 5,260,537 | A | 11/1993 | Beckett | |
| 5,266,386 | A | 11/1993 | Beckett | |
| 5,269,717 | A | 12/1993 | Tardif | |
| 5,309,749 | A | 5/1994 | Stodd | |
| RE34,683 | E | 8/1994 | Maynard et al. | |
| 5,340,436 | A | 8/1994 | Beckett | |
| 5,354,973 | A | 10/1994 | Beckett | |
| 5,410,135 | A | 4/1995 | Pollart et al. | |
| 5,424,517 | A | 6/1995 | Habeger, Jr. et al. | |
| 5,519,195 | A | 5/1996 | Keefer et al. | |
| 5,617,972 | A | 4/1997 | Morano et al. | |
| 5,628,921 | A | 5/1997 | Beckett | |
| 5,672,407 | A | 9/1997 | Beckett | |
| 5,735,785 | A | 4/1998 | Lucas et al. | |
| 5,755,824 | A | 5/1998 | Blechschmidt et al. | |
| 5,758,773 | A | 6/1998 | Clements | |
| 5,759,422 | A | 6/1998 | Schmelzer et al. | |
| 5,782,376 | A | 7/1998 | Brauner et al. | |
| 5,800,724 | A | 9/1998 | Habeger et al. | |
| 5,934,472 | A | 8/1999 | Ramirez et al. | |
| 5,938,112 | A | 8/1999 | Sandstrom | |
| 6,093,460 | A | 7/2000 | Iwaya | |
| 6,114,679 | A | 9/2000 | Lai et al. | |
| 6,150,646 | A | 11/2000 | Lai et al. | |
| 6,204,492 | B1 | 3/2001 | Zeng et al. | |
| 6,213,301 | B1 | 4/2001 | Landis et al. | |
| 6,251,451 | B1 | 6/2001 | Zeng | |
| 6,284,101 | B1 | 9/2001 | Marx | |
| 6,325,213 | B1 | 12/2001 | Landis, II | |
| 6,414,290 | B1 | 7/2002 | Cole et al. | |
| 6,415,945 | B1 | 7/2002 | Zank et al. | |
| 6,433,322 | B2 | 8/2002 | Zeng et al. | |
| 6,455,827 | B2 | 9/2002 | Zeng | |
| 6,552,315 | B2 | 4/2003 | Zeng et al. | |
| 6,568,534 | B2 | 5/2003 | Zank | |
| 6,592,357 | B1 | 7/2003 | Johns et al. | |
| 6,677,563 | B2 | 1/2004 | Lai | |
| 6,715,630 | B2 | 4/2004 | Littlejohn et al. | |
| 6,717,121 | B2 | 4/2004 | Zeng et al. | |
| 6,765,182 | B2 | 7/2004 | Cole et al. | |
| 6,893,693 | B2 | 5/2005 | Swoboda et al. | |
| 6,907,316 | B2 | 6/2005 | Bader et al. | |
| 6,988,654 | B2 | 1/2006 | Wnek | |
| 7,048,176 | B2 | 5/2006 | Littlejohn et al. | |
| 7,169,346 | B2 | 1/2007 | Johns et al. | |
| 7,337,943 | B2 | 3/2008 | Johns et al. | |
| 7,365,292 | B2 | 4/2008 | Cole et al. | |
| 7,419,462 | B1 | 9/2008 | Zelinski | |
| 7,482,053 | B2 | 1/2009 | Swiontek | |
| 7,540,833 | B2 | 6/2009 | Johns et al. | |
| 7,819,790 | B2 * | 10/2010 | Grischenko | B31B 43/00 100/215 |
| 7,862,318 | B2 | 1/2011 | Middleton et al. | |
| 7,914,432 | B2 | 3/2011 | Zelinski | |
| 8,047,834 | B2 * | 11/2011 | Sofronie | B29C 43/36 264/334 |
| 2002/0092791 | A1 | 7/2002 | Wnek | |
| 2003/0205319 | A1 | 11/2003 | Bengtsson et al. | |
| 2003/0214076 | A1 | 11/2003 | Johns | |
| 2004/0069788 | A1 | 4/2004 | Johns et al. | |
| 2004/0262322 | A1 | 12/2004 | Middleton et al. | |
| 2005/0109653 | A1 | 5/2005 | Wnek et al. | |
| 2006/0198972 | A1 | 9/2006 | Ueda et al. | |
| 2007/0081743 | A1 | 4/2007 | Kim | |
| 2007/0262487 | A1 | 11/2007 | O'Hagan et al. | |
| 2007/0267374 | A1 | 11/2007 | Middleton et al. | |
| 2008/0047958 | A1 | 2/2008 | Cole et al. | |
| 2008/0251574 | A1 * | 10/2008 | Zelinski | B31B 43/00 229/407 |
| 2009/0223952 | A1 * | 9/2009 | Wnek | B31B 43/00 219/730 |
| 2011/0160028 | A1 * | 6/2011 | Wnek | B31B 43/00 493/52 |

FOREIGN PATENT DOCUMENTS

| | | |
|---|---|---|
| DE | 36 40 069 | 9/1987 |
| DE | 87 13 290 | 1/1988 |
| DE | 37 37 052 A1 | 5/1989 |
| DE | 296 02 348 U1 | 5/1996 |
| DE | 101 49 143 A1 | 4/2003 |
| EP | 0 082 209 | 6/1983 |
| EP | 1 332 972 | 8/2003 |
| FR | 2 266 638 | 10/1975 |
| FR | 2 599 002 | 11/1987 |
| FR | 2 733 715 | 11/1996 |
| GB | 1 264 484 | 2/1972 |
| GB | 1 348 370 | 3/1974 |
| GB | 1 376 603 | 12/1974 |
| GB | 2 171 048 | 8/1986 |
| JP | 47-23456 | 10/1972 |
| JP | 54-116059 | 9/1979 |
| JP | 54-126887 | 10/1979 |
| JP | 56065866 U | 6/1981 |
| JP | 59-75004 | 4/1984 |
| JP | 62-131744 | 8/1987 |
| JP | 03-004582 | 1/1991 |
| JP | 3057020 U | 5/1991 |
| JP | 6000843 | 1/1994 |
| JP | 60-96234 | 4/1994 |
| JP | 07-28883 | 1/1995 |
| JP | 08-156944 | 6/1996 |
| JP | 3031361 | 9/1996 |
| JP | 8-337234 | 12/1996 |
| JP | 08-337235 | 12/1996 |
| JP | 09-254948 | 9/1997 |
| JP | 11-138663 | 5/1999 |

(56) References Cited

FOREIGN PATENT DOCUMENTS

| | | | |
|---|---|---|---|
| JP | 2000-043840 | | 2/2000 |
| JP | 2000-142825 | | 5/2000 |
| JP | 2000-238760 | | 9/2000 |
| JP | 2000-335550 | | 12/2000 |
| JP | 2000-517260 | | 12/2000 |
| JP | 2001-213420 | | 8/2001 |
| JP | 2001-328617 | | 11/2001 |
| KR | 20-0367200 | Y1 | 11/2004 |
| WO | WO 96-11142 | | 4/1996 |
| WO | WO 98-09812 | | 3/1998 |
| WO | WO 03/066435 | | 8/2003 |
| WO | WO 03/078012 | | 9/2003 |
| WO | WO 2004-033324 | | 4/2004 |
| WO | WO 2008-049048 | | 4/2008 |
| WO | WO 2009-086501 | | 7/2009 |
| WO | WO 2009-088904 | | 7/2009 |

OTHER PUBLICATIONS

International Search Report and Written Opinion for PCT/US2010/062303 dated Sep. 5, 2011.
Japanese Office Action for 2012-516289 dated Apr. 18, 2013 with English translation.
Canadian Office Action for 2,761,154 dated Feb. 7, 2013.
International Search Report & Written Opinion for PCT/US2007/081743 dated May 28, 2008.
Supplementary European Search Report for EP 03776279 dated Jan. 28, 2009.
Office Action for U.S. Appl. No. 12/817,377 dated Aug. 2, 2012.
Response to Restriction Requirement for U.S. Appl. No. 12/817,377 dated Aug. 23, 2012.
Office Action for U.S. Appl. No. 12/817,377 dated Nov. 2, 2012.
Amendment A and Response to Office Action for U.S. Appl. No. 12/817,377 dated Dec. 27, 2012.
Notice of Allowance and Fee(s) Due for U.S. Appl. No. 12/817,377 dated Mar. 6, 2013.
Amendment Under 37 CFR § 1.312 for U.S. Appl. No. 12/817,377 dated Apr. 17, 2013.
Response to Rule 312 Communication for U.S. Appl. No. 12/817,377 dated Apr. 24, 2013.
Part B—Fee s Transmittal for U.S Appl. No. 12/817,377 dated Jun. 6, 2013.
Issue Notification for U.S. Appl. No. 12/817,377 dated Jun. 19, 2013.
Supplementary European Search Report for EP 10 79 0174 dated Jan. 19, 2017.

* cited by examiner

TOOL FOR FORMING A THREE DIMENSIONAL CONTAINER OR CONSTRUCT

CROSS-REFERENCE TO RELATED APPLICATIONS

This application is a divisional of U.S. patent application Ser. No. 12/817,377, filed Jun. 17, 2010, which claims the benefit of U.S. Provisional Patent Application No. 61/187,849, filed Jun. 17, 2009.

INCORPORATION BY REFERENCE

U.S. patent application Ser. No. 12/817,377, which was filed on Jun. 17, 2010, and U.S. Provisional Patent Application No. 61/187,849, which was filed on Jun. 17, 2009, are hereby incorporated by reference for all purposes as if presented herein in its entirety.

BACKGROUND OF THE DISCLOSURE

The present disclosure relates to tools and methods for forming materials into articles, elements, constructs, or containers that may be used to hold, contain, or prepare food products or other products.

SUMMARY OF THE DISCLOSURE

In one aspect, the disclosure is generally directed to a tool for forming a container from a blank. The tool has a blank locating feature that locates the blank in the tool for forming into the container.

In one aspect, the disclosure is generally directed to a tool for forming a container from a blank. The tool comprises a first tool assembly, and a second tool assembly. At least one of the first tool assembly and the second tool assembly is moveable between an open position of the tool wherein the blank is received between the first and the second tool assembly and a closed position of the tool wherein the blank is formed into the container. A blank positioning system is adjacent at least one of the first tool assembly and the second tool assembly. The blank positioning system has features for positioning the blank in an aligned position wherein the blank is axially aligned with the first tool assembly and the second tool assembly in the open position of the tool.

In another aspect, the disclosure is generally directed to a blank positioning system for use in a tool for forming a container from a blank. The tool has a first tool assembly and a second tool assembly. At least one of the first tool assembly and the second tool assembly is moveable between an open position of the tool wherein the blank is received between the first and the second tool assembly and a closed position of the tool wherein the blank is formed into the container. The blank positioning system comprises a blank infeed table adjacent the at least one of the first tool assembly and the second tool assembly, the blank infeed table being for positioning the blank in an aligned position wherein the blank is axially aligned with the first tool assembly and the second tool assembly in the open position of the tool.

In another aspect, the disclosure is generally directed to a method of forming a container from a blank. The method comprises obtaining a tool comprising a first tool assembly, a second tool assembly, and a blank positioning system, obtaining a blank to be formed into the container, positioning at least one of the first tool assembly and the second tool assembly in an open position of the tool, conveying the blank to the blank positioning system. The method comprises activating features of the blank positioning system to position the blank between the first tool assembly and the second tool assembly, wherein the blank is axially aligned with the first tool assembly and the second tool assembly. The conveying the blank comprises moving the blank from an upstream end of the tool assembly. The method comprises positioning at least one of the first tool assembly and the second tool assembly in a closed position of the tool and pressing the blank between the tool assemblies to form the blank into the container.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure relates generally to various aspects of materials, packages, elements, articles, containers and methods of making such materials, packages, elements, articles and containers. Although several different features, aspects, implementations, and embodiments are provided, numerous interrelationships between, combinations thereof, and modifications of the various features, aspects, implementations, and embodiments of the disclosure are contemplated hereby. In one illustrated embodiment, the present disclosure relates to forming a container for heating or cooking food items, such as in a microwave oven. However, in other embodiments, the disclosure can be related to forming articles or containers that are not used for microwave cooking.

The present disclosure includes a forming tool 1 for forming a container C (FIG. 8) suitable for use in heating or cooking a food item. The container C may be similar to the containers discloses in the following U.S. Patents and U.S. Patent Applications: U.S. Pat. No. 7,365,292; U.S. Pat. App. Pub. Nos. 2005/0109653; 2008/0047958; 2008/049048; and 2007/0262487, the above-noted documents being incorporated by reference herein for all purposes. Also, the forming tool 1 of the present disclosure can have similar features to any of the various forming tools and forming features disclosed in the above-identified patents and published patent applications.

Figure 1:
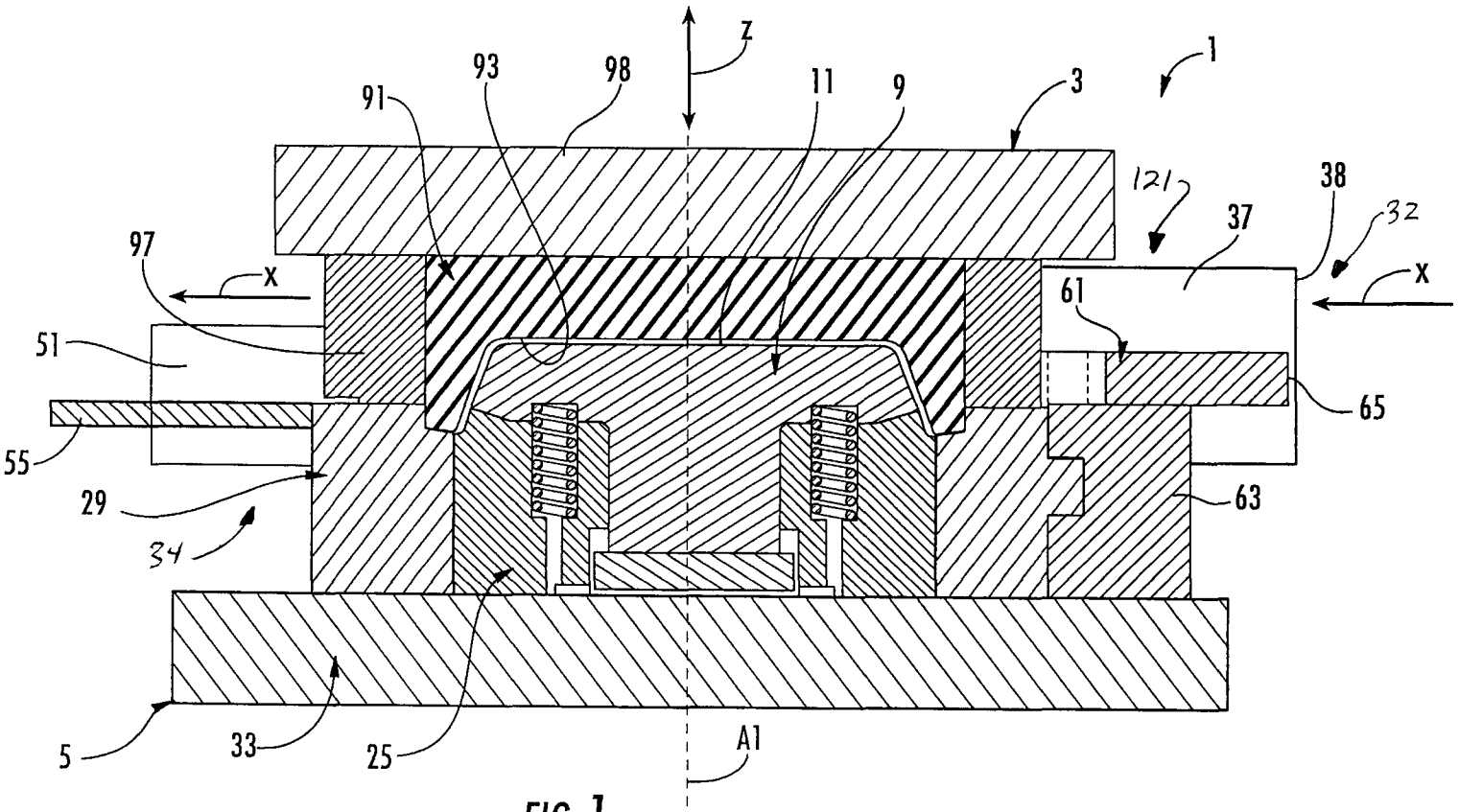
FIG. 1 is a cross-section of a forming tool of one embodiment of the disclosure.
Figure 2:
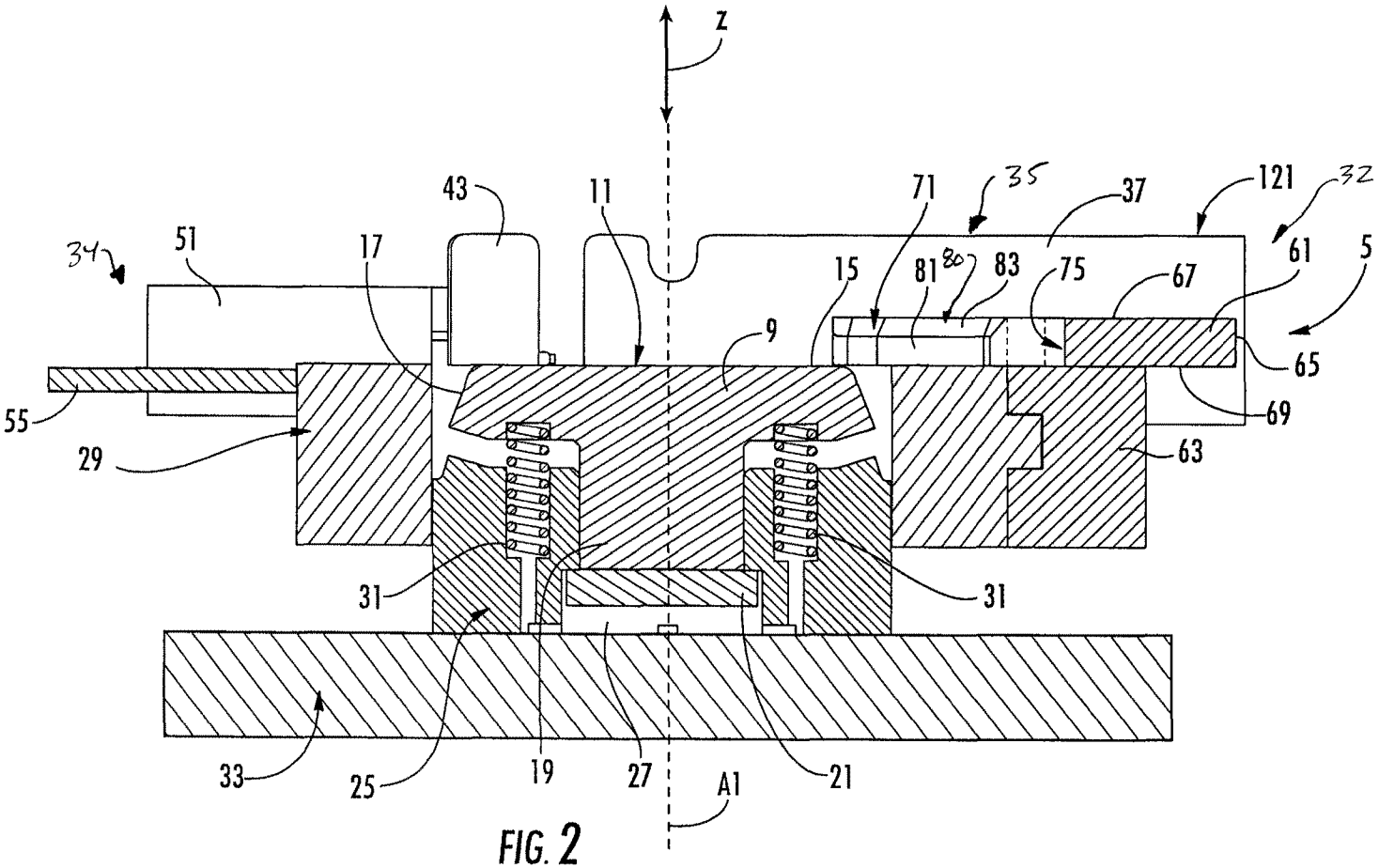
FIG. 2 is a cross-section of a lower tool assembly of FIG. 1.
Figure 5:
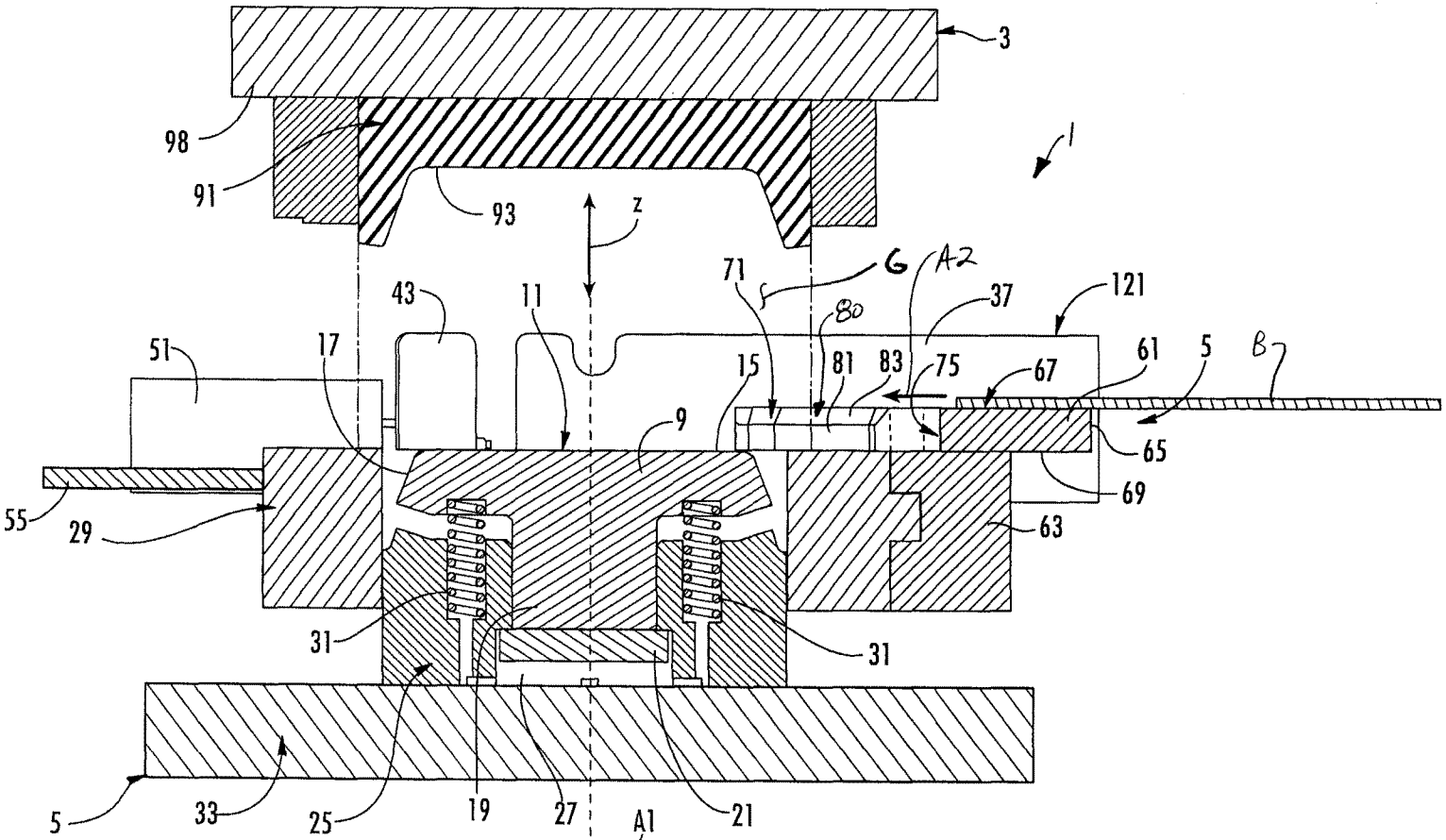
FIGS. 5-8 are cross-sections of the forming tool showing various positioning and steps of forming a blank into a construct.
Figure 6:
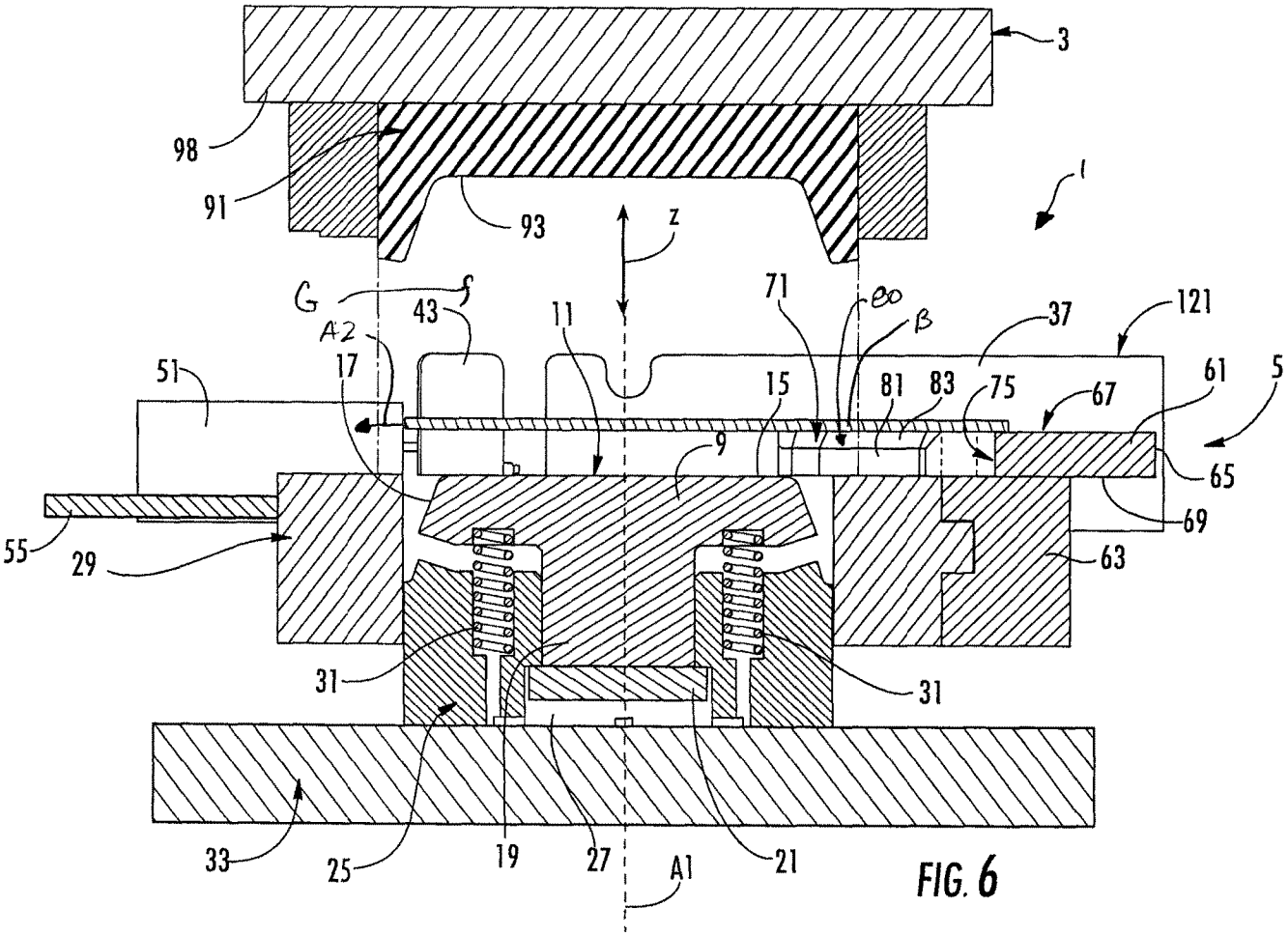

In the illustrated embodiment, the forming tool 1 includes an upper (first) tool assembly 3 and a lower (second) tool assembly 5. The upper and lower tool assemblies 3 and 5 are independently moveable in the vertical direction Z along a central axis A1 of the assembly to form a blank B into the three-dimensional container. It is understood that the upper and lower tool assemblies 3, 5 are moved in the vertical direction Z from the position shown in FIG. 1 to form a gap G (FIGS. 5 and 6) between the assemblies so that the blank B traveling in the horizontal direction X is located between the upper and lower tool assemblies prior to the forming process. In the illustrated embodiment, the upper and lower tool assemblies 3, 5 are configured to form the container C (FIG. 8) having a generally oval-shaped bottom wall BW and upwardly extending side walls S that form a generally oval-shaped cavity CV of the container. The upper and lower forming tool assemblies 3, 5 could be otherwise configured to form containers having other three-dimensional shapes (e.g., containers with circular-shaped bottom wall/cavity, containers with rectangular-shaped bottom wall/cavity, etc.). After being formed from the blank B in the forming tool 1, the container C can be discharged from the forming tool and further moved in the X-direction and subjected to additional forming or shaping processes, or can be further handled without departing from the scope of this disclosure.

Figure 3:
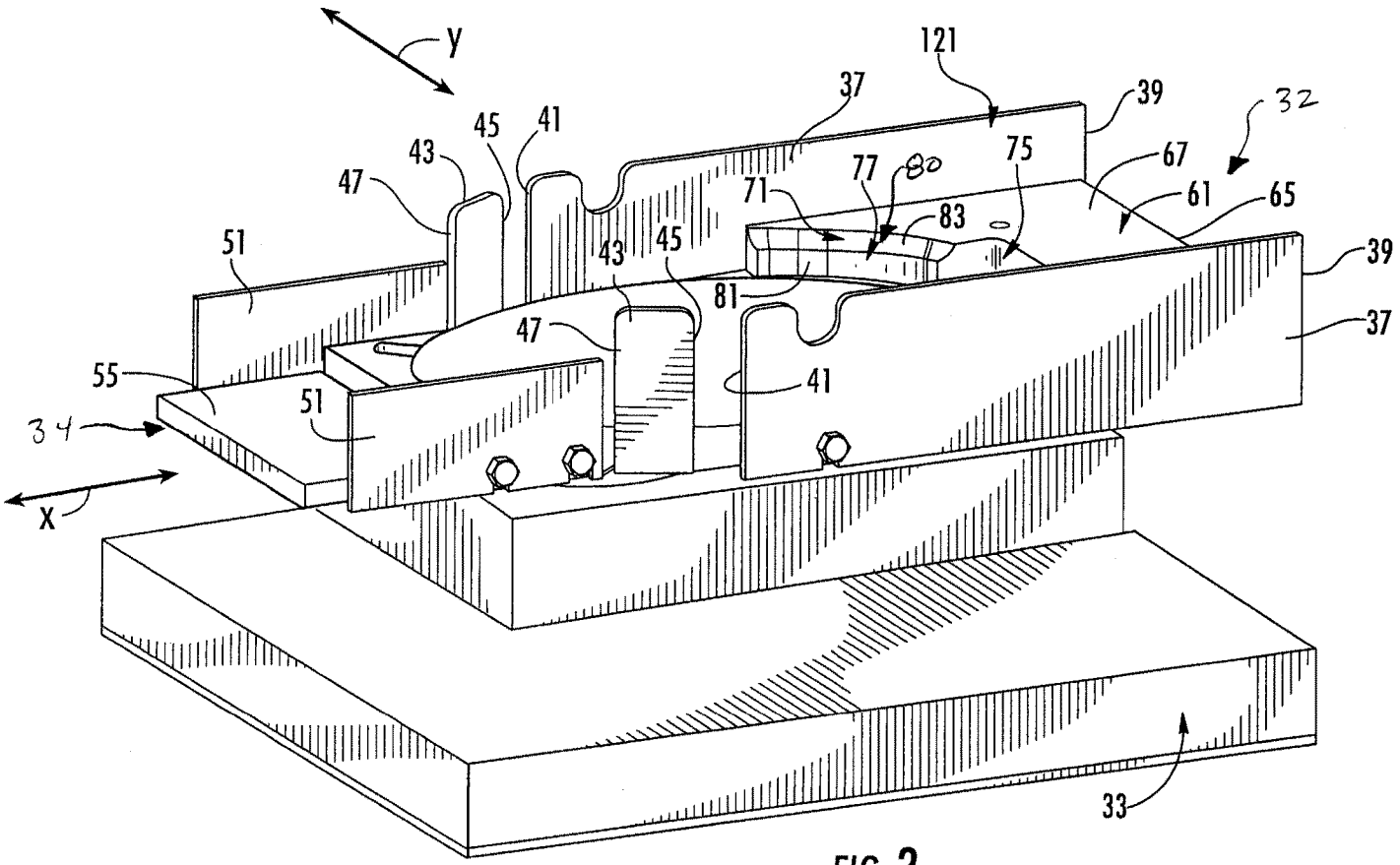
FIG. 3 is a perspective of the lower tool assembly.

In the illustrated embodiment, the lower tool assembly 5 has a nose 9 forming a first axial end surface 11 of the lower tool assembly. The nose 9 has a side surface 17 that extends downward from the axial surface 11. The nose 9 has a cylindrical shaft 19 connected to a guide bushing 21. The lower tool assembly 5 includes a base plate 25 having a central bore 27 that moveably receives the shaft 19 and the guide bushing 21. In the illustrated embodiment, the nose 9 is operatively connected to the base plate 25 by springs 31. A draw ring 29 is located adjacent the base plate 25 and extends around the perimeter thereof. The lower tool assembly 5 includes a bottom plate 33 that supports the base plate 25. In one embodiment, the draw ring 29 is moveable in the Z-direction relative to the bottom plate 33 and the base plate 25. As shown in FIG. 3, the lower tool assembly 5 has an upstream end 32 to which blanks are fed or conveyed in the X-direction, and downstream end 34 where containers C formed from the blanks are discharged from the tool 1 and further conveyed for packaging and/or further processing. It is understood that the tool could be otherwise oriented such that the upstream end 32 and downstream end 34 are otherwise positioned without departing from the disclosure.

In the illustrated embodiment, the tool 1 comprises a blank positioning system 121 mounted on the lower tool assembly 5, generally at the upstream end 32 of the tool. In one embodiment, the blank positioning system 121 comprises first blank guides 37 that are attached at opposite sides of the lower tool assembly 5 to guide the blank B and prevent movement of the blank in the Y-direction (FIG. 3) that is perpendicular to the direction of travel of the blank (X-direction). The first blank guides 37 each have a respective upstream end 39 and a respective downstream end 41. In the illustrated embodiment, the blank positioning system 121 includes middle blank guides 43 that are located adjacent the outer surface of the draw ring 29 and a respective upstream end 39 of the first blank guides 37. In the illustrated embodiment, the middle blank guides 43 are angled with respect to the first blank guides 37 and have a respective upstream end 45 and downstream end 47. In the illustrated embodiment, the lower tool assembly 5 comprises exit guides 51 that are located adjacent the downstream ends 47 of the middle blank guides 43. An exit plate 55 is located at a downstream side of the draw ring 29 and is between the exit guides 51. In one embodiment, the exit guides 51 are positioned to be in a generally parallel planar relationship with the first blank guides 37, but are spaced inward from and are separated by a smaller distance in the X-direction than the first blank guides. In the illustrated embodiment, the first blank guides 37, middle blank guides 43, and exit blank guides 51 are generally rectangular plates that extend upward from and are generally perpendicular to the axial end surface 11 of the nose 9. The blank guides 37, 43, 51 can be alternatively shaped, arranged, and/or located without departing from this disclosure.

Figure 4A:
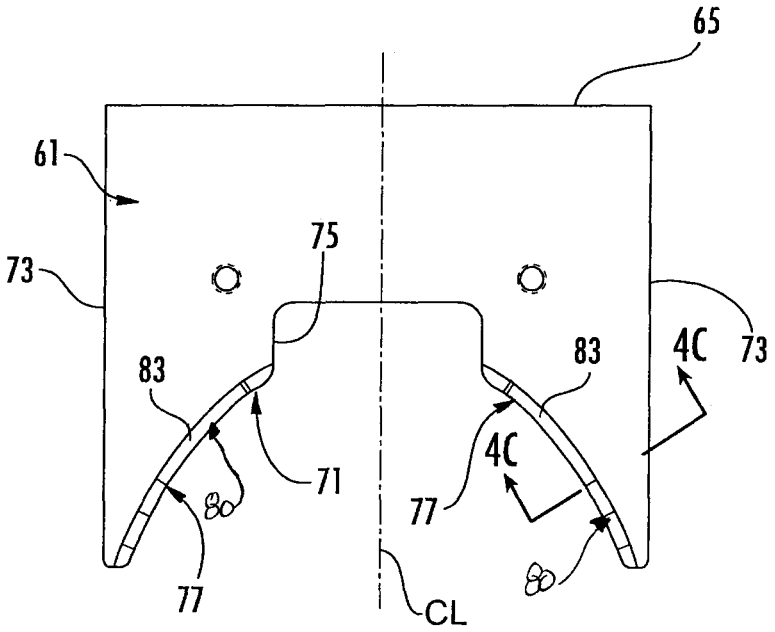
FIG. 4A is a top plan view of a blank infeed table of the lower tool assembly.
Figure 4B:
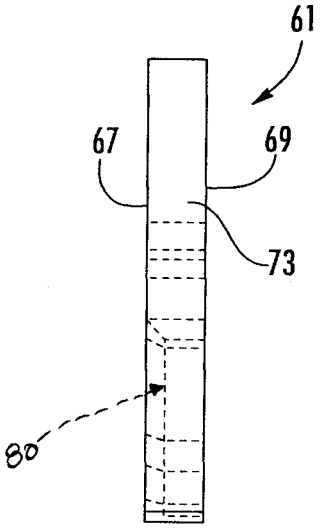
FIG. 4B is a side view of the blank infeed table of FIG. 4A.
Figure 4C:
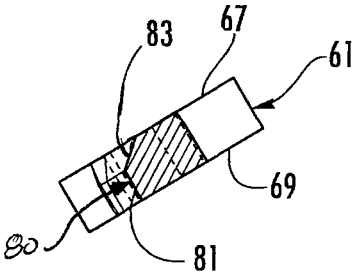
FIG. 4C is a cross-section of the blank infeed table taken along plane 4C-4C of FIG. 4A.

In the illustrated embodiment, the blank positioning system 121 comprises a blank infeed table 61 located at the upstream side of the lower tool assembly 5. The blank infeed table 61 is supported above the bottom plate 33 of the lower tool assembly 5 by a support 63. The blank infeed table 61 is shown in detail in FIGS. 4A-4C. The blank infeed table 61 has a generally flat upstream end surface 65, an upper surface or face 67, a lower surface or face 69, a downstream end surface 71, and two opposed side surfaces 73. The opposed side surfaces 73 are adjacent a respective one of the first blank guides 37. In the illustrated embodiment, the downstream end surface 71 has a generally rectangular notch 75 located on the centerline CL of infeed table 61 and two arcuate portions 77 respectively extending from the rectangular notch. In one embodiment, each of the two arcuate portions 77 of the downstream end surface 71 includes a blank guiding surface 80 comprising a lower portion 81 that extends generally perpendicular from the bottom surface 69 and an upper portion 83 that is contoured and extends obliquely (in cross-sectional view of FIG. 4C) from the lower portion to the top face 67. In the illustrated embodiment, the upper portion 83 of the blank guiding surface 80 is positioned at an angle of at least approximately 60 degrees relative to the flat top surface 67 of the infeed table 61. However, the upper portion 83 could be otherwise shaped and/or arranged (e.g., angled more or less than 60 degrees relative to the top surface 67) without departing from the disclosure. The blank infeed table 61 could be otherwise shaped, arranged, and/or positioned without departing from the disclosure.

In the illustrated embodiment, the upper tool assembly 3 includes a cavity block or cavity 91 having a recess 93 generally shaped to correspond with the shape of the container C. A clamp ring 97 is located adjacent an outer radial surface of the cavity block 91. The clamp ring 97 is operatively connected to a base plate 98. The upper tool assembly 3 can be otherwise shaped, arranged, and/or configured and can have more or less than the components shown and described herein without departing from the disclosure.

In the illustrated embodiment, the lower tool assembly 5 includes the blank positioning system 121 at the upstream side of the forming tool assembly 1 that comprises the first blank guides 37, middle blank guides 43, and the blank infeed table 61. The blank positioning system 121 provides precise positioning of the blank B in the X and Y-directions prior to forming the blank B into the container C. In one embodiment, the blank B is generally oval-shaped and is slid across the blank infeed table 61 and is positioned by the blank positioning system 121 to be in the proper location above the lower forming tool assembly 5 prior to press-forming the blank into the container.

A method of forming the container C from the blank is described below. The container of the present disclosure is formed from the blank B by feeding the blank into the forming tool assembly 1 and operating the assembly to press and shape the blank into the container. The blank B can be moistened to facilitate forming of the container C. After the upper tool assembly 3 and lower tool assembly 5 have been separated (FIG. 5) to form the gap G, the blank B is slid across the blank infeed plate 61 and is positioned in between the upper and lower tool assemblies 3, 5 by the first blank guides 37 and middle blank guides 43 of the blank positioning system 121. A conveying mechanism, such as a conveyor belt (not shown) or other suitable material handling mechanism, conveys the blank B in the direction of arrow A1 to the proper position between the upper tool assembly 3 and lower tool assembly 5. At the fully open position of the upper and lower tool assemblies 3, 5, the blank is supported by the axial end surface 11 of the nose 9 and the draw ring 29 on the lower tool assembly.

Figure 7:
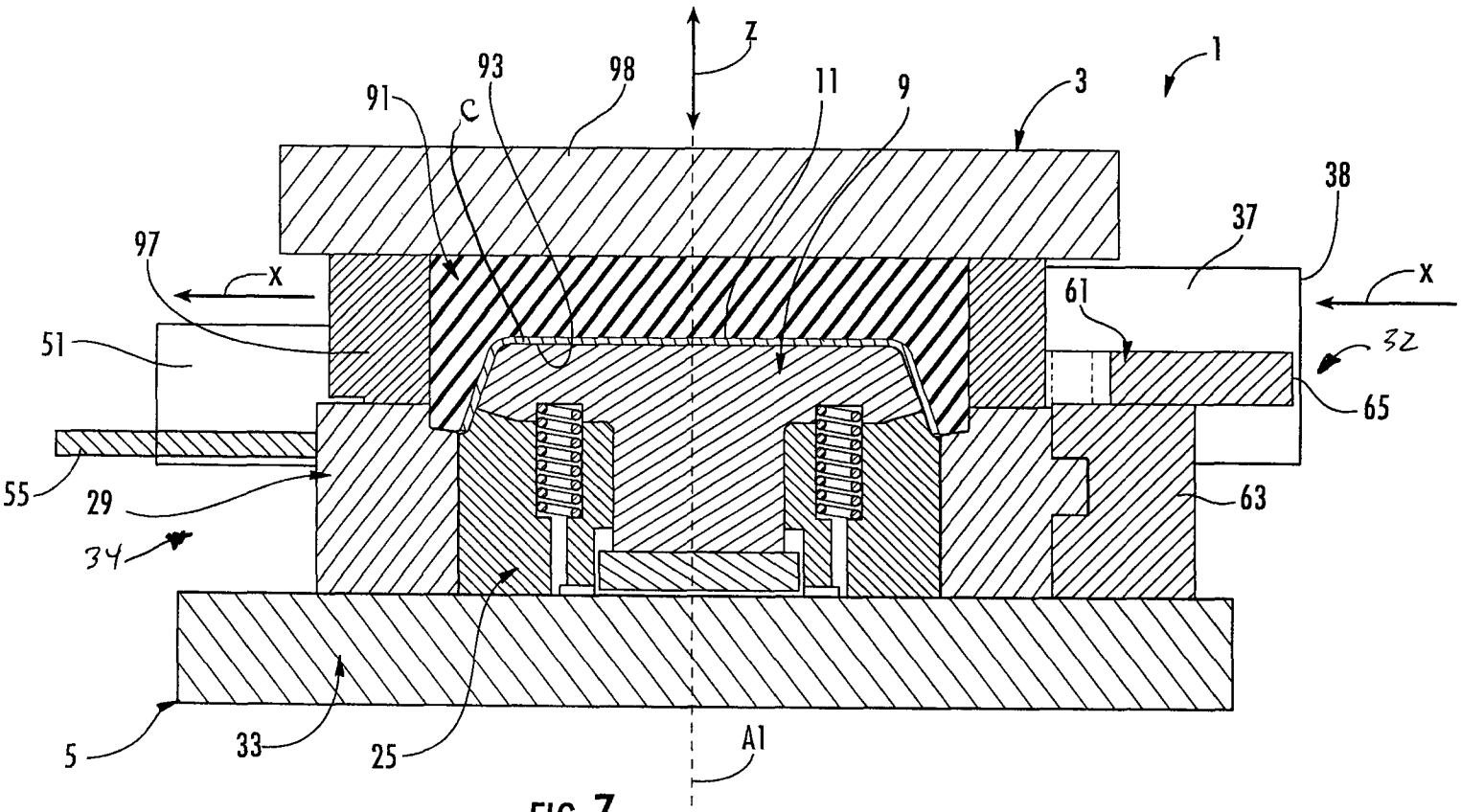
Figure 8:
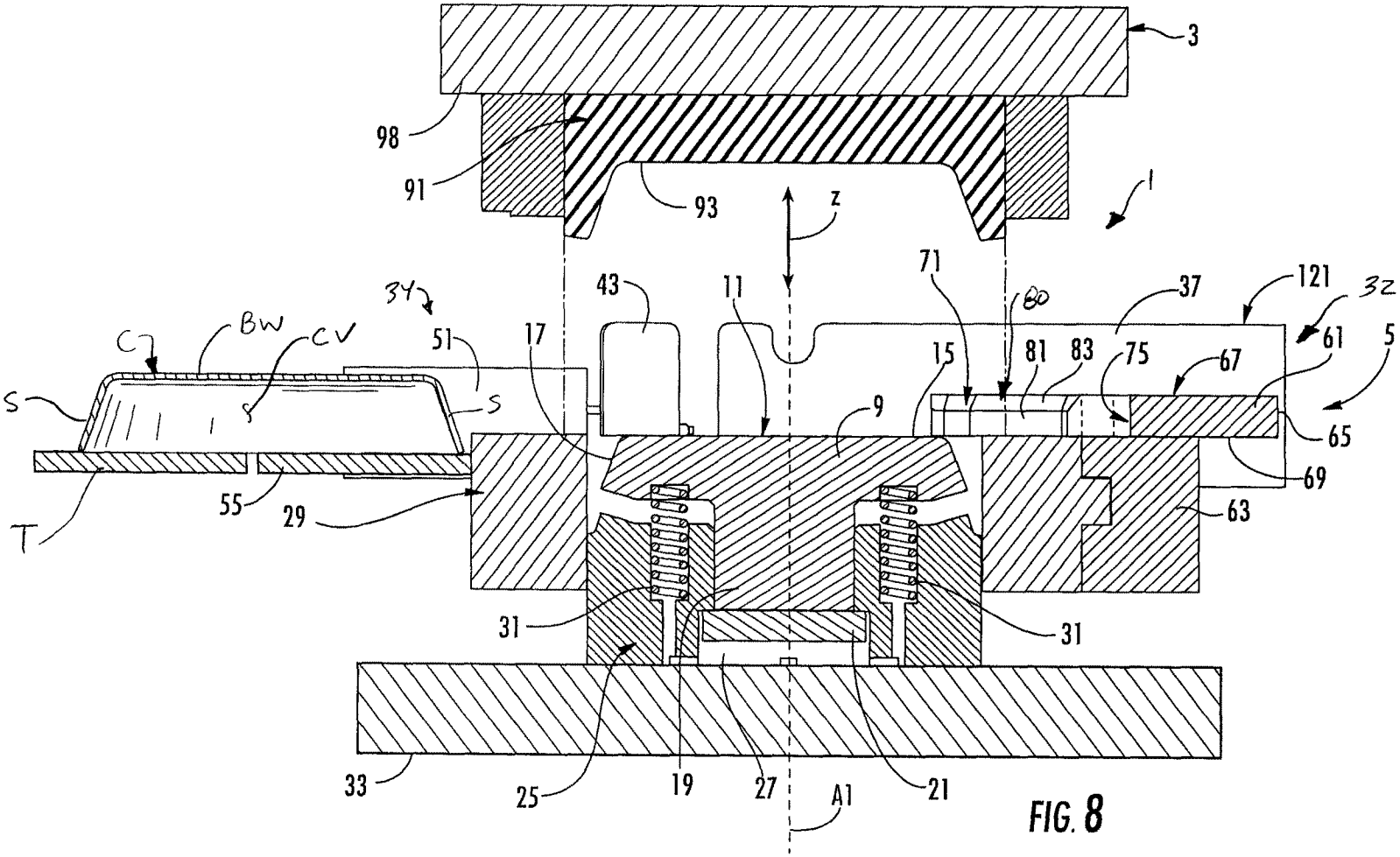

After the blank B is positioned in the proper, centered position above the lower tool assembly by the blank positioning system 121, the upper tool assembly 3 is actuated to initiate downward movement toward the lower tool assembly 5. The blank B is pressed between the nose 9 and the cavity block 91 so that the blank is pressed into a three-dimensional shape of the container C (FIGS. 7 and 8).

In addition to the capability of forming articles from a generally oval-shaped blank, the X and Y-directional position control of the blank positioning system 121 can be beneficial in forming any three-dimensional article or container from blanks that are other than oval-shaped. For example, the forming tool 1 could form a container, having a cavity that is otherwise shaped (e.g., round, square, rectangular, etc.), from an appropriately sized and shaped blank. In one embodiment, the container could be a three dimensional container such as a tray having a bottom wall and at least one side wall.

After the container C is shaped (FIG. 7), the upper tool assembly 3 is raised and the container C is ejected from the tool assembly 1 (FIG. 8) such that the container exits the downstream end of the tool assembly such that the container is supported by the exit plate 55 and is guided by the exit guides 51. The container can be further conveyed in the X-direction by a conveying mechanism (e.g., conveyor belt) for further processing, packaging, and/or shipment or for assembly into a finished food product package. In the illustrated embodiment a table T or support surface is adjacent to the exit plate 55, but the table T could be a portion of a conveying mechanism that further conveys the containers C.

In one embodiment, the upper tool assembly 3 and lower tool assembly 5 can be mounted at approximately a 45° angle in a machine (not shown) of the type manufactured by Peerless Machine & Tool Corporation in Marion, Ind., USA. The machine provides the primary compressive forces to sufficiently close and open the tool assemblies 3, 5 of the present disclosure. The closing and opening of the tool assemblies 3, 5 by the machine forms the three-dimensional articles or containers C. In other types of machines, the tool assemblies 3, 5 may be revised/modified to permit the tool assemblies to operate in alternative orientations (e.g., upside down or on their side). It should be understood that the operating position of tool assemblies 3 and 5 shown and/or described herein is not intended to limit the scope of the disclosure.

As mentioned above, in accordance with the exemplary embodiment of the present disclosure, the container can include microwave interactive material that may comprise a microwave interactive element such as a susceptor. The container can include microwave interactive elements or material as is disclosed in any of the U.S. Patents and Published Patent Applications that are noted above and incorporated by reference herein. Alternatively, the microwave interactive material can comprise any other type of microwave interactive elements, materials, and/or various combinations of microwave interactive elements and material, as discussed in greater detail below. The microwave interactive elements and materials may be omitted from the container without departing from the scope of this disclosure.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A method of forming a container from a blank, the method comprising:

obtaining a tool comprising a first tool assembly, a second tool assembly, and a blank positioning system, wherein the blank positioning system comprises a blank infeed table adjacent the at least one of the first tool assembly and the second tool assembly, wherein the blank infeed table has an upper face and a blank guiding surface comprising a contoured upper portion adjacent the upper face, and the blank positioning system further comprises a pair of blank guides, each blank guide of the pair of blank guides extending above the upper face of the blank infeed table, each blank guide of the pair of blank guides is spaced from the blank infeed table in a downstream direction, each blank guide of the pair of blank guides is oblique with respect to the downstream direction;

obtaining a blank to be formed into the container;

positioning at least one of the first tool assembly and the second tool assembly in an open position of the tool;

conveying the blank to the blank positioning system to position the blank between the first tool assembly and the second tool assembly, the conveying the blank comprises moving the blank in the downstream direction from an upstream end of the tool along the upper face of the blank infeed table and then engaging the blank with the blank guiding surface of the blank infeed table, and the conveying the blank further comprises engaging the blank with at least one of the blank guides of the pair of blank guides; and positioning at least one of the first tool assembly and the second tool assembly in a closed position of the tool and pressing the blank between the tool assemblies to form the blank into the container.

2. The method of claim 1 wherein the blank infeed table comprises a lower face, the blank guiding surface comprises a lower portion adjacent the lower face, the upper portion of the blank guiding surface extends downwardly from the upper face to the lower portion.

3. The method of claim 1 wherein each blank guide of the pair of blank guides comprises a generally rectangular plate that is attached to the at least one of the first tool assembly and the second tool assembly.

4. The method of claim 1 wherein each blank guide of the pair of blank guides is a first blank guide and the blank positioning system comprises a pair of middle blank guides positioned in the downstream direction from the pair of first blank guides and the blank infeed table, wherein each middle blank guide of the pair of middle blank guides is positioned at an angle with respective to each first blank guide of the pair of first blank guides.

5. The method of claim 4 wherein each middle blank guide of the pair of middle blank guides comprises a generally rectangular plate that is attached to the at least one of the first tool assembly and the second tool assembly.

6. The method of claim 1 wherein the tool further comprises a pair of exit guides positioned in the downstream direction from the blank positioning system, the method further comprises discharging the container formed from the blank from the tool, and guiding the container with the pair of exit guides at a downstream end of the tool.

7. The method of claim 6 wherein each exit guide of the pair of exit guides comprises a generally rectangular plate that is attached to the at least one of the first tool assembly and the second tool assembly.

8. The method of claim 6 wherein the tool further comprises an exit plate positioned between the exit guides of the pair of exit guides, the discharging the container further comprises supporting the container on the exit plate.

9. The method of claim 1 wherein the first tool assembly comprises a nose having an external surface shaped to generally correspond to at least a portion of the container and the second tool assembly comprises a cavity block having a recess shaped to correspond with at least a portion of the container, the nose and the cavity block cooperating to form the container from the blank when the nose is at least partially received in the cavity block.

10. The method of claim 1 wherein the first tool assembly comprises a nose having an external surface shaped to generally correspond to at least a portion of the container and the second tool assembly comprises a cavity block having a recess, the pressing the blank between the tool assemblies to form the blank into the container comprises pressing the blank between the nose and the cavity block to form the blank into the container.

11. The method of claim 1 wherein at least one of the first tool assembly and the second tool assembly is moveable between the open position of the tool wherein the blank is received between the first and second tool assembly and the closed position of the tool wherein the blank is formed into the container.

12. The method of claim 11 wherein the blank positioning system is adjacent at least one of the first tool assembly and the second tool assembly.

13. The method of claim 12 wherein the blank positioning system has features for positioning the blank in an aligned position wherein the blank is axially aligned with the first tool assembly and the second tool assembly in the open position of the tool.

14. The method claim of claim 1, wherein each blank guide of the pair of blank guides extends along respective opposite side surfaces of the blank infeed table.

15. The method of claim 14, wherein each blank guide of the pair of blank guides further extends from a downstream end surface of the blank infeed table in the downstream direction.

16. A method of forming a container from a blank, the method comprising:

obtaining a tool comprising a first tool assembly, a second tool assembly, and a blank positioning system, wherein the blank positioning system comprises a blank infeed table adjacent the at least one of the first tool assembly and the second tool assembly, wherein the blank infeed table has an upper face, a blank guiding surface comprising a contoured upper portion adjacent the upper face, and opposing side surfaces, and the blank positioning system further comprises a air of blank guides, each blank guide of the air of blank guides extending above the upper face of the blank infeed table, and each blank guide of the pair of blank guides extends along the respective side surfaces of the blank infeed table;

obtaining a blank to be formed into the container;

positioning at least one of the first tool assembly and the second tool assembly in an open position of the tool;

conveying the blank to the blank positioning system to position the blank between the first tool assembly and the second tool assembly, the conveying the blank comprises moving the blank in a downstream direction from an upstream end of the tool along the upper face of the blank infeed table and then engaging the blank with the blank guiding surface of the blank infeed table; and positioning at least one of the first tool assembly and the second tool assembly in a closed position of the tool and pressing the blank between the tool assemblies to form the blank into the container.

17. The method of claim 16, wherein each blank guide of the pair of blank guides further extends from the blank guiding surface of the blank infeed table in the downstream direction.

* * * * *